US007041892B2

(12) United States Patent
Becker

(10) Patent No.: US 7,041,892 B2
(45) Date of Patent: May 9, 2006

(54) AUTOMATIC GENERATION OF MUSICAL SCRATCHING EFFECTS

(75) Inventor: Friedemann Becker, Osterholz-Schambeck (DE)

(73) Assignee: Native Instruments Software Synthesis GmbH, Berlin (DE)

( * ) Notice: Subject to any disclaimer, the term of this patent is extended or adjusted under 35 U.S.C. 154(b) by 32 days.

(21) Appl. No.: 10/481,391

(22) PCT Filed: Jun. 18, 2002

(86) PCT No.: PCT/EP02/06708

§ 371 (c)(1),
(2), (4) Date: Dec. 17, 2003

(87) PCT Pub. No.: WO02/103671

PCT Pub. Date: Dec. 27, 2002

(65) Prior Publication Data

US 2004/0177746 A1 Sep. 16, 2004

(30) Foreign Application Priority Data

Jun. 18, 2001 (DE) ..... 101 29 301
Sep. 5, 2001 (DE) ..... 101 53 673

(51) Int. Cl.
*G10H 7/00* (2006.01)

(52) U.S. Cl. ..... 84/603

(58) Field of Classification Search ..... 84/603–605
See application file for complete search history.

(56) References Cited

U.S. PATENT DOCUMENTS 4,300,225 A * 11/1981 Lambl ..... 369/2
5,256,832 A 10/1993 Miyake
5,270,477 A 12/1993 Kawashima
5,313,011 A * 5/1994 Koguchi ..... 84/609
5,350,882 A * 9/1994 Koguchi et al. ..... 84/636
5,512,704 A * 4/1996 Adachi ..... 84/605
5,627,335 A 5/1997 Rigopulos et al.
5,763,804 A 6/1998 Rigopulos et al.
5,915,288 A 6/1999 Gabriel
5,973,255 A * 10/1999 Tanji ..... 84/636
6,011,212 A 1/2000 Rigopulos et al.
6,025,552 A * 2/2000 Mukaino et al. ..... 84/605
6,479,740 B1 * 11/2002 Schwartz et al. ..... 84/609
6,541,690 B1 * 4/2003 Segers, Jr. ..... 84/605
6,818,815 B1 * 11/2004 Cohen ..... 84/645
2001/0017829 A1 8/2001 Inoue et al.
2001/0017832 A1 * 8/2001 Inoue et al. ..... 369/53.34
2003/0029305 A1 * 2/2003 Kent et al. ..... 84/645
2003/0205123 A1 * 11/2003 Yamada et al. ..... 84/603
2004/0069123 A1 * 4/2004 Becker et al. ..... 84/612
2004/0144237 A1 * 7/2004 Hoshiai et al. ..... 84/612

FOREIGN PATENT DOCUMENTS

EP 0 764 934 A1 3/1997
WO WO 97/01168 A1 1/1997
WO WO 97/15043 A1 4/1997

* cited by examiner

*Primary Examiner*—Jeffrey W Donels
(74) *Attorney, Agent, or Firm*—Squire, Sanders & Dempsey

(57) ABSTRACT

The invention relates to a method for generating electrical sounds and to an interactive music player. According to the invention, an audio signal in digital format, which lasts for a predeterminable length of time, is used as the starting material. The reproduction position and/or the reproduction direction and/or the reproduction speed of said signal is/are modulated automatically with respect to the rhythm using control information in different predeterminable ways, based on information concerning the musical tempo.

29 Claims, 6 Drawing Sheets

BACK AND FOR

AUTOMATIC GENERATION OF MUSICAL SCRATCHING EFFECTS

FIELD OF THE INVENTION

The invention relates to a method for electrical sound production and an interactive music player, in which an audio signal provided in digital format and lasting for a predeterminable duration is used as the starting material.

BACKGROUND OF THE INVENTION

In present-day dance culture which is characterised by modern electronic music, the occupation of the disc jockey (DJ) has experienced enormous technical developments. The work required of a DJ now includes the arranging of music titles to form a complete work (the set, the mix) with its own characteristic spectrum of excitement.

In the vinyl-disk DJ sector, the technique of scratching has become widely established. Scratching is a technique, wherein the sound material on the vinyl disk is used to produce rhythmic sound through a combined manual movement of the vinyl disk and a movement of a volume controller on the mixing desk (so-called fader). The great masters of scratching perform this action on two or even three record players simultaneously, which requires the dexterity of a good percussion player or pianist.

Increasingly, hardware manufacturers are advancing into the real-time effects sector with effect mixing desks. There are already DJ mixing desks, which provide sample units, with which portions of the audio signal can be re-used as a loop or a one-shot-sample. There are also CD players, which allow scratching on a CD using a large jog wheel.

However, no device or method is so far known, with which both the playback position of a digital audio signal and also the volume characteristic or other sound parameters of this signal can be automatically controlled in such a manner that, a rhythmically accurate, beat-synchronous "scratch effect" is produced from the audio material heard at precisely the same moment. This would indeed be desirable because, firstly, successful scratch effects would be reproducible and also transferable to other audio material; and secondly, because the DJ's attention can be released and his/her concentration increased in order to focus on other artistic aspects, such as the compilation of the music.

SUMMARY OF THE INVENTION

The object of the present invention is therefore to provide a method and a music player, which allow automatic production of musical scratch effects.

This object is achieved according to the invention in each case by the independent claims.

Further advantageous embodiments are specified in the dependent claims.

BRIEF DESCRIPTION OF THE DRAWINGS

Advantages and details of the invention are described with reference to the description of advantageous exemplary embodiments below and with reference to the drawings. The diagrammatic drawings are as follows.

DETAILED DESCRIPTION OF THE INVENTION

Figure 1:
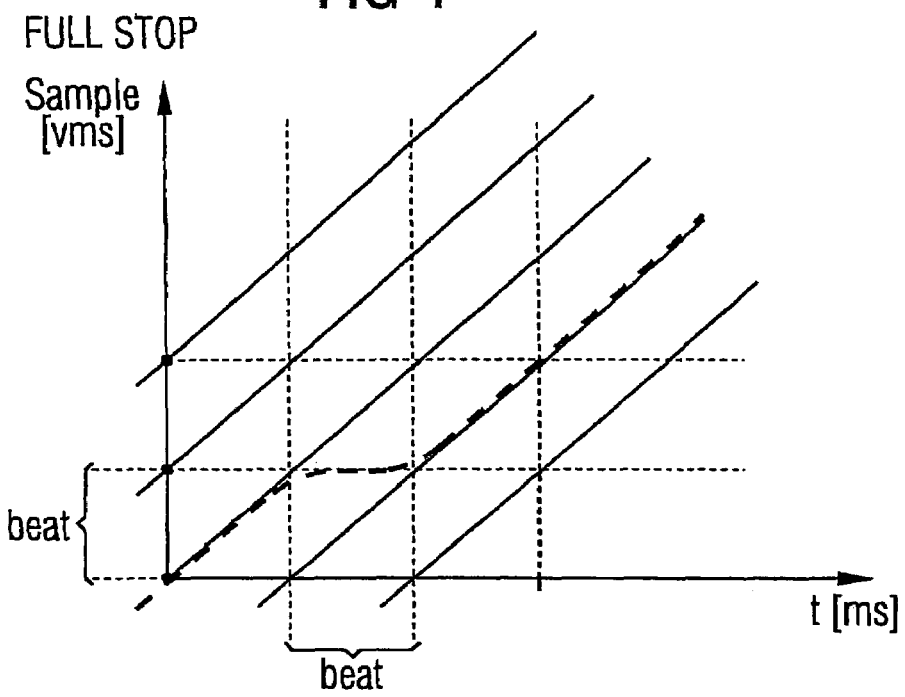
FIG. 1 shows a time-space diagram of all playback variants disposed together on the beat of track reproduced at normal speed in the form of a parallel straight line of gradient 1.

In order to play back pre-produced music, different devices are conventionally used for various storage media such as vinyl disks, compact discs or cassettes. These formats were not developed to allow interventions into the playback process in order to process the music in the creative manner. However, this possibility is desirable and nowadays, in spite of the given limitations, is indeed practised by the DJs mentioned above. In this context, vinyl disks are preferably used, because with vinyl disks, it is particularly easy to influence the playback rate and position by hand.

Nowadays, however, predominantly digital formats such as audio CD and MP3 formats are used for the storage of music. In the case of MP3, this represents a compression method for digital audio data according to the MPEG standard (MPEG 1 Layer 3). The method is asymmetric, that is to say, coding is very much more complicated than decoding. Furthermore, it is a method associated with losses. The present invention allows creative work with music as mentioned above using any digital formats by means of an appropriate interactive music player, which makes use of the new possibilities created by the measures according to the invention as described above.

In this context, there is a need in principle to have as much helpful information in the graphic representation as possible, in order to intervene in as targeted a manner as possible. Moreover, it is desirable to intervene ergonomically in the playback process, in a comparable manner to the "scratching" frequently practised by DJs on vinyl-disk record players, wherein the turntable is held or moved forwards and backwards during playback.

In order to intervene in a targeted manner, it is important to have a graphic representation of the music, in which the current playback position can be identified and also wherein a certain period in the future and in the past can be identified. For this purpose, amplitude envelope curves of the sound-wave form are generally presented over a period of several seconds before and after the playback position. The representation moves in real-time at the rate at which the music is played.

In principle, it is desirable to have as much helpful information in the graphic representation as possible in order to intervene in a targeted manner. Moreover, it is desirable to intervene ergonomically in the playback procedure, in a manner comparable to the so-called "scratching" on vinyl-disk record players. In this context, the term "scratching" refers to the holding or moving forwards and backwards of the turntable during playback.

With the interactive music player created by the invention, it is possible to extract musically relevant points in time, especially the beats, using the beat detection function explained below, (FIG. 7 and FIG. 8) from the audio signal and to indicate these as markings in the graphic representation, for example, on a display or on a screen of a digital computer, on which the music player is realised by means of appropriate programming.

Furthermore, a hardware control element R1 is provided, for example, a button, especially a mouse button, which allows switching between two operating modes:

a) music playing freely, at a constant tempo;

b) playback position and playback rate are influenced either directly by the user or automatically.

Mode a) corresponds to a vinyl disk, which is not touched and the velocity of which is the same as that of the turntable. By contrast, mode b) corresponds to a vinyl disk, which is held by the hand or moved backwards and forwards.

Figure 7:
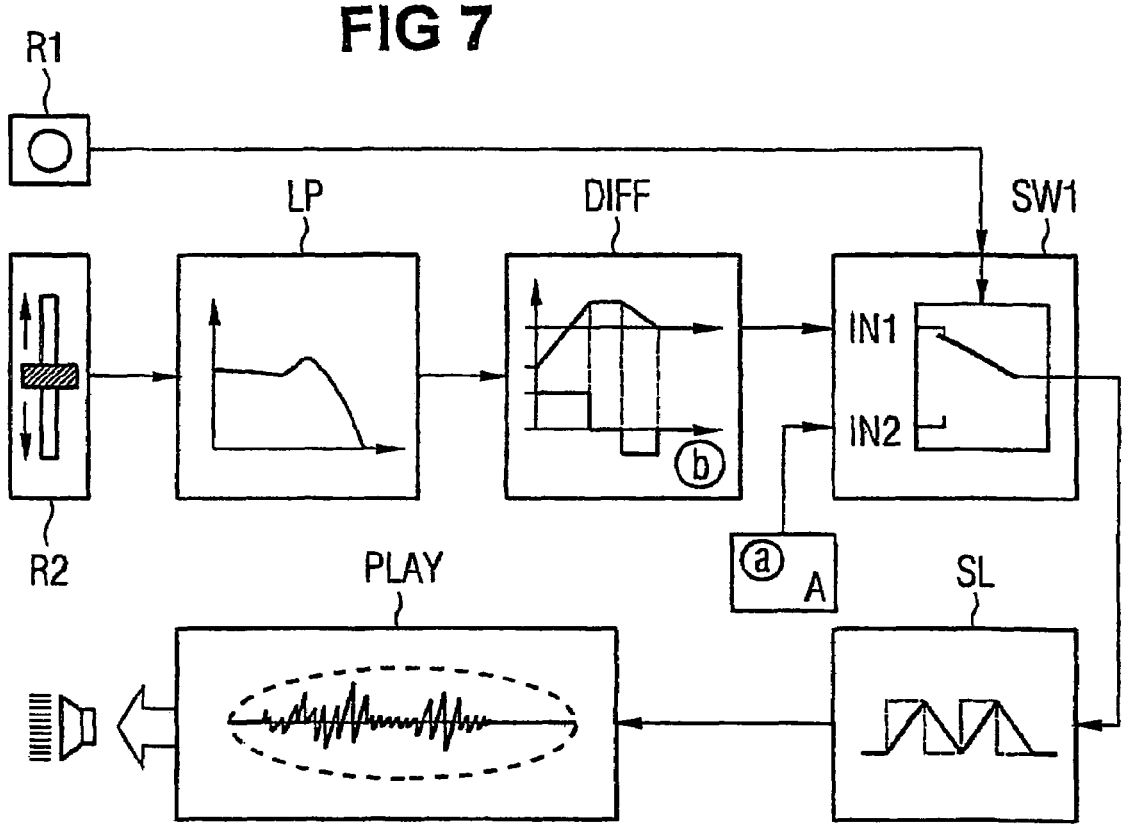
FIG. 7 shows a block circuit diagram for visualising the acquisition of rhythm-relevant information and its evaluation for the approximation of tempo and the phase of a music data stream.
Figure 8:
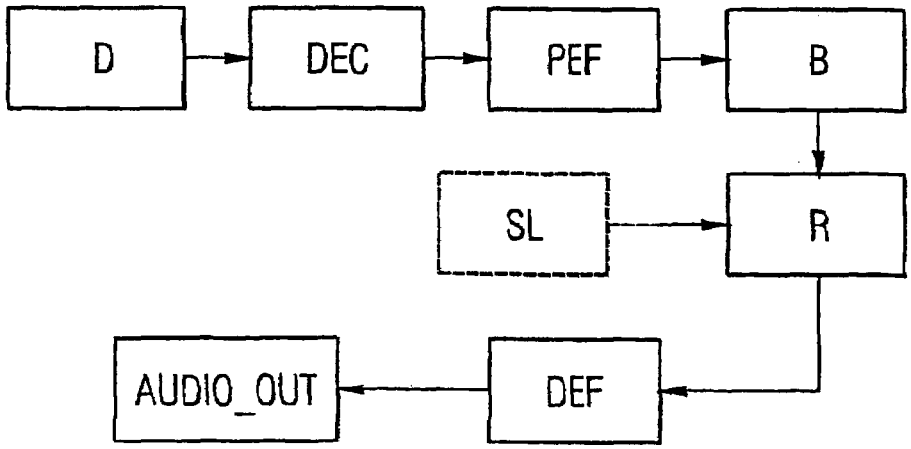
FIG. 8 shows a further block circuit diagram for the successive correction of detected tempo and phase.

In one advantageous embodiment of an interactive music player, the playback rate in mode a) is further influenced by the automatic control for synchronising the beat of the music played back to another beat (cf. FIG. 7 and FIG. 8). The other beat can be produced synthetically or can be provided by other music playing at the same time.

Moreover, another hardware control element R2 is provided, with which the disk position can, so to speak, be determined in operating mode b). This may be a continuous controller or also a computer mouse.

Figure 5:
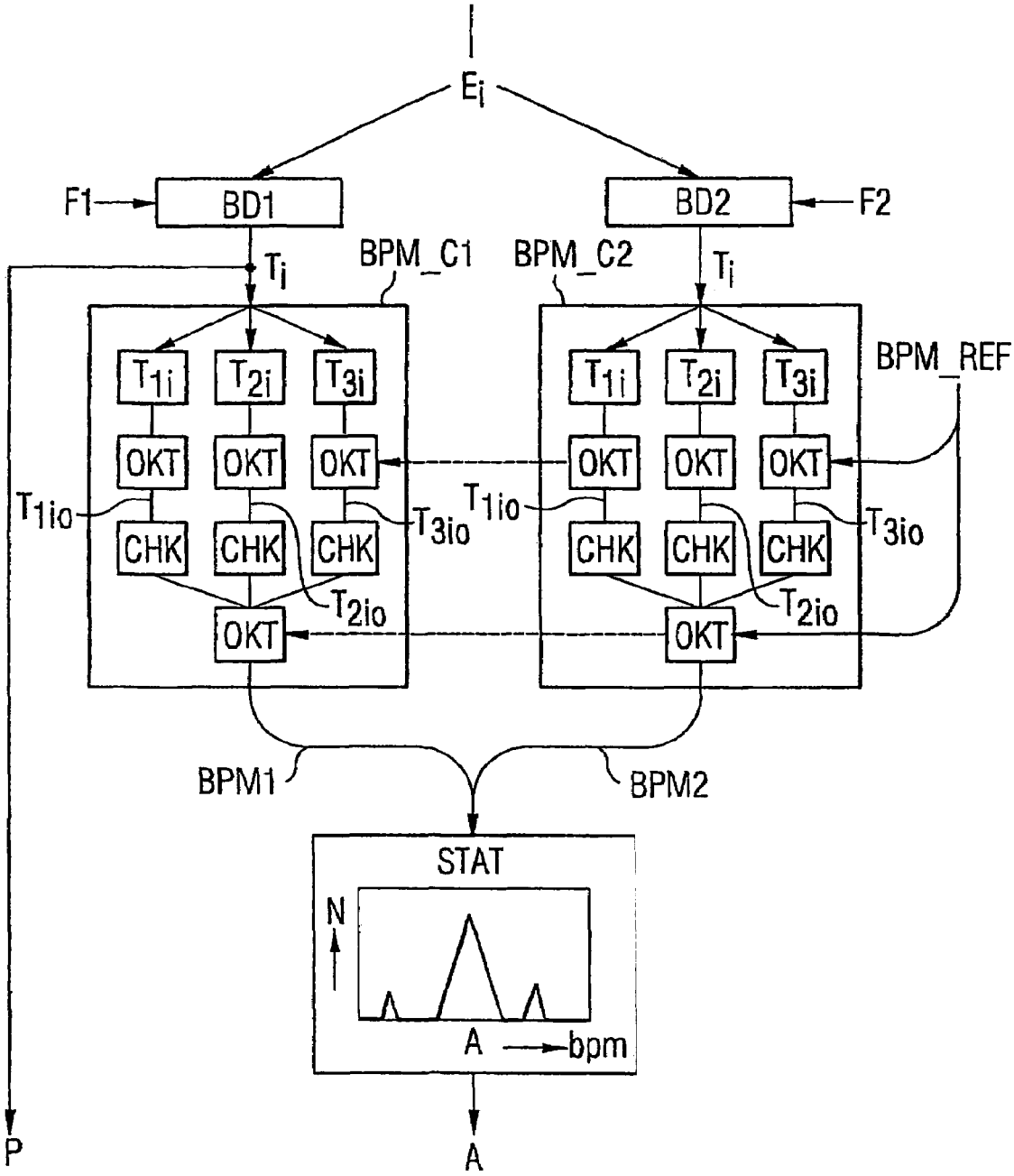
FIG. 5 shows a block circuit diagram of an interactive music player according to the invention with the possibility of intervention into a current playback position.

The drawing according to FIG. 5 shows a block circuit diagram of an arrangement of this kind with signal processing means explained below, with which an interactive music player is created according to the invention with the possibility of intervention into the current playback position.

The position data specified with this further control element R2 normally have a limited time resolution, that is to say, a message communicating the current position is only sent at regular or irregular intervals. The playback position of the stored audio signal should, however, change uniformly, with a time resolution, which corresponds to the audio scanning rate. Accordingly, at this position, the invention uses a smoothing function, which produces a high-resolution, uniformly changing signal from the stepped signal specified by the control element R2.

One method in this context is to trigger a ramp of constant gradient for every predetermined position message, which, in a predetermined time, moves the smoothed signal from its old value to the value of the position message. Another possibility is to pass the stepped wave form into a linear digital low-pass filter LP, of which the output represents the desired smoothed signal. A 2-pole resonance filter is particularly suitable for this purpose. A combination (series connection) of the two smoothing processes is also possible and advantageous because it allows the following advantageous signal-processing chain:

Predetermined stepped signal→ramp smoothing→low-pass filter→exact playback position Or Predetermined stepped signal→low-pass filter→ramp smoothing→exact playback position The block circuit diagram according to FIG. 5 illustrates an advantageous exemplary embodiment in the form of a sketch diagram. The control element R1 (in this example, a key) is used for changing the operating mode a), b), by triggering a switch SW1. The controller R2 (in this example, a continuous slide controller) provides the position information with time-limited resolution. This is used as an input signal by a low-pass filter LP for smoothing. The smoothed position signal is now differentiated (DIFF) and supplies the playback rate. The switch SW1 is controlled with a signal to a first input IN1 (mode b). The other input IN2 is supplied with a tempo value A, which can be determined as described in FIG. 7 and FIG. 8 (mode a). Switching between the input signals takes place via the control element R1.

Moreover, via a third control element (not shown) the control information described above can be specified for automatic manipulation of playback position and/or playback direction and/or playback rate. A further control element is then used to trigger the automatic manipulation of the playback position and/or playback direction and/or playback rate specified by the third control element.

If the user switches from one mode into the other (which corresponds to holding and releasing the turntable), the position must not jump. For this reason, the proposed interactive music player adopts the position reached in the preceding mode as the starting position in the new mode. Similarly, the playback rate (first derivation of the position) must not change abruptly. Accordingly, the current rate is adopted and passed through a smoothing function, as described above, moving it to the rate which corresponds to the new mode. According to FIG. 5, this takes place through a slew limiter SL, which triggers a ramp with a constant gradient, which moves the signal, in a predetermined time, from its old value to the new value. This position-dependent and/or rate-dependent signal then controls the actual playback unit PLAY for the reproduction of the audio track by influencing the playback rate.

The complicated movement procedures, according to which the disk and the cross fader must collaborate in a very precise manner adapted to the tempo, can now be automated by means of the arrangement shown in FIG. 5 with the corresponding control elements and using a meta-file format described in greater detail below. The length and type of the scratch can be selected from a series of preliminary settings. The actual course of the scratch is controlled in a rhythmically accurate manner by the method according to the invention. In this context, the movement procedures are either recorded before a real-time scratch or they are drafted "on the drawing board" in a graphic editor.

The automated scratch module now makes use of the so-called scratch algorithm described above with reference to FIG. 5.

The method presented above requires only one parameter, namely the position of the hand with which the virtual disk is moved (cf. corresponding control element), and from this information calculates the current playback position in the audio sample by means of two smoothing methods. The use of this smoothing method is a technical necessity rather than a theoretical necessity. Without its use, it would be necessary to calculate the current playback position at the audio rate (44 kHz) in order to achieve an undistorted reproduction, which would require considerably more calculating power. With the algorithm, the playback position can be calculated at a much lower rate (e.g. 344 Hz).

With reference to the two simplest scratch automations, the section below explains how the method for automatic production of scratch effects functions according to the invention. However, the same method can also be used for much more complex scratch sequences.

Full Stop

This scratch is an effect, in which the disk is brought to a standstill (either by hand or by operating the stop key of the record player). After a certain time, the disk is released again, and/or the motor is switched on again. After the disk has returned to its original rotational speed, it must again be positioned in tempo at the "anticipated" beat before the scratch and/or in tempo on a second, reference beat, which has not been affected by the full stop.

The following simplifying assumptions have been made in order to calculate the slowing, standstill and acceleration phases. (However, more complex procedures of the scratch can be calculated without additional complexity):

- both slowing and acceleration are carried out in a linear manner, that is, with a constant acceleration.
- slowing and acceleration take place with the same acceleration but with a reversed symbol The drawing shown in FIG. 1 illustrates a time-space diagram of all mutually synchronous playback variants and/or playback variants located together on the beat for a track played back at the normal rate. The duration of a quarter note in a present track in this context is described as a beat.

If all the playback variants of a track played back at normal speed which are located together on the beat (beat) are portrayed as parallel straight lines with gradient 1 in a time-space diagram (x-axis: time t in [ms], y-axis sample position SAMPLE in [ms]), then a FULL STOP scratch can be represented as a connecting curve (broken line) between two of the parallel playback lines. The linear velocity transition between the movement phases and the standstill phase of the scratch is represented in the time-space diagram as a parabolic-segment (linear velocity change=quadratic position change).

Figure 2:
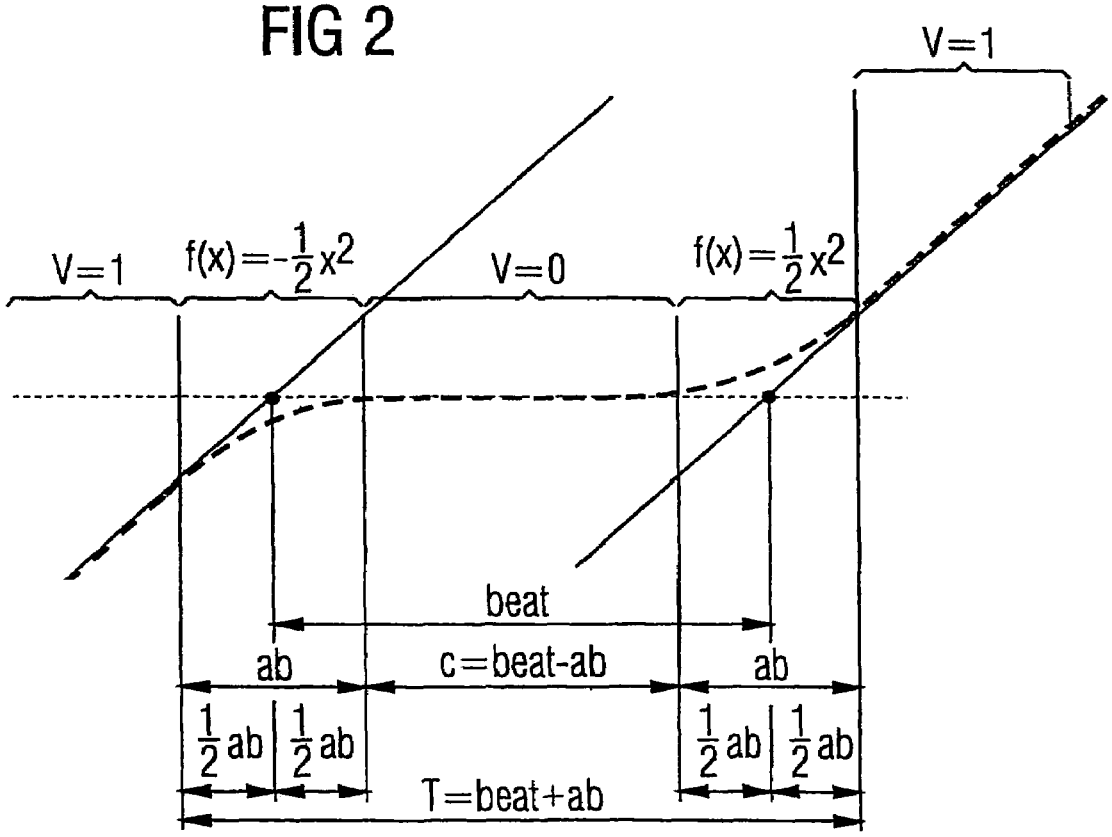
FIG. 2 shows a detail from the time-space diagram according to FIG. 1 for the description of the geometric conditions of a Full-Stop scratch effect.

Some geometric considerations on the basis of the diagram shown in FIG. 1 now allow the duration of various phases (slowing, standstill, acceleration) to be calculated in such a manner that after the completion of the scratch, the playback position comes to lie on a straight line parallel to the original straight line and offset by a whole number multiple of a quarter note (beat), which represents the graphic equivalent of the demand described above for beat-synchronous reproduction of the movement. In this context, FIG. 2 shows an excerpt from FIG. 1, wherein the following mathematical considerations can be understood.

If the duration of the slowing and acceleration procedure is designated as 'ab', the velocity as v, the playback position correlated with time t as x and the duration of a quarter note of the present track as the beat, then the duration for the standstill phase c to be observed can be calculated as follows:

$$c=\text{beat}-ab$$

The total duration T of the scratch is $$T=\text{beat}+ab$$

and therefore consists of 3 phases:

| | |
|---|---|
| slowing from v = 1 to v = 0: | duration: ab |
| standstill: | duration: beat − ab |
| acceleration from v = 0 to v = 1: (for ab <= beat) | duration: ab |

This means that initially, the playback is at normal speed v=1, before a linear slowing $f(x)=\frac{1}{2}x^2$ takes place, which lasts for the time 'ab'. For the duration 'beat−ab' the standstill is v=0, before a linear acceleration $f(x)=\frac{1}{2}x^2$ takes place, which again lasts for the time 'ab'. After this, the normal playback rate is restored.

The duration 'ab' for slowing and acceleration has been deliberately kept variable, because by changing this parameter, it is possible to intervene in a decisive manner in the "sound" (quality) of scratch. (See Initial Settings).

If the standstill phase c is prolonged by multiples of a beat, it is possible to produce beat-synchronous Full-Stop scratches of any length.

Back and For

Figure 3:
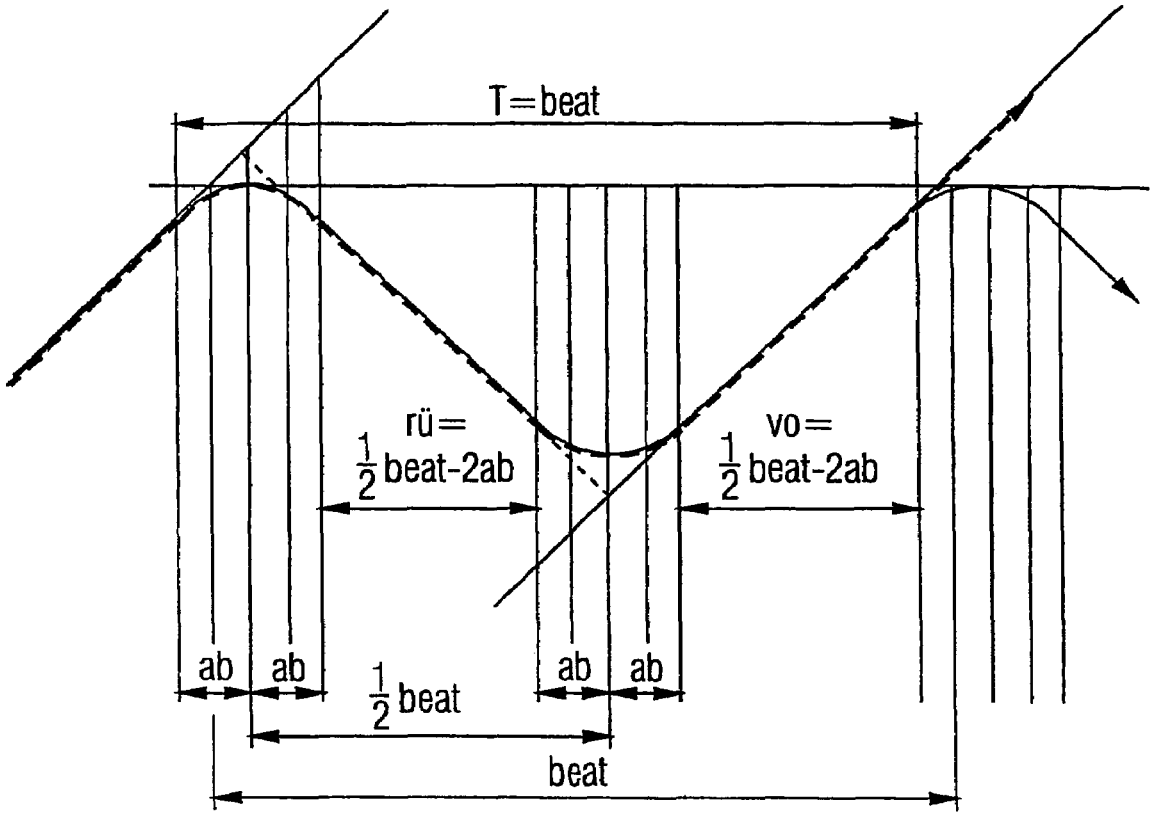
FIG. 3 shows and excerpt from a time-space diagram for the description of the geometric conditions for a Back-and-For scratch effect.

This scratch represents a moving of the virtual disk forwards and backwards at a given position in a tempo-synchronous manner and, after completion of the scratch, returning to the original beat and/or a reference beat. The same time-space diagram from FIG. 1 can again be used and, in its simplest form, $$\text{velocity}=+/-1;\ \text{frequency}=1/\text{beat},$$

this scratch can be illustrated as in the drawing according to FIG. 3, which is based on FIG. 2. Of course, considerably more complex movement procedures can also be calculated in this manner.

Slowing from v=+1 to v=−1 and vice versa now requires double the duration=2*ab. With geometric considerations, the duration of the reverse play phase "back" [rü] and the subsequent forward phase "for" [vo] can be determined as shown in FIG. 3:

$$\text{back}=fo=\tfrac{1}{2}*\text{beat}-2ab$$

In this case, the total duration of the scratch is exactly T=beat and consists of 4 phases:

| | |
|---|---|
| slowing from v = 1 to v = −1: | duration: 2ab |
| reverse: | duration: ½ * beat − 2ab |
| acceleration from v = −1 to v = 1: | duration: 2ab |
| forward play: | duration: ½ * beat − 2ab |

This scratch can be repeated as often as required and always returns to the starting-playback position; overall, the virtual disk does not move forward. This therefore means a shift by p=−beat by comparison with the reference beat with every iteration.

In this scratch, the duration of the slowing and acceleration feature 'ab' also remains variable, because the characteristics of the scratch can be considerably changed by altering 'a'.

Gater

In addition to the actual manipulation of the original playback rate, a scratch gains in diversity through additional rhythmic emphasis of certain passages of the movement procedure by means of volume or EQ/filter (sound characteristic) manipulations. For example, in the case of a BACK AND FOR scratch, only the reverse phase may be rendered audible, while the forward phase is masked.

With the present method, this process has also been automated by using the tempo information (cf. FIG. 7 and FIG. 8) extracted from the audio material in order to control these parameters in a rhythmic manner.

The following paragraph illustrates merely by way of example how a great diversity of effect variations are possible using just 3 parameters.

RATE (frequency of the gate procedure),

SHAPE (relationship of "on" to "off") and

OFFSET (phase displacement, relative to the reference beat).

These three parameters can naturally also be used on EQs/filters or any other audio effect, such as Hall, Delay or similar, rather than merely on the volume of the scratch.

The Gater itself already exists in many effect devices. However, the combination with a tempo-synchronous scratch algorithm to produce fully automatic scratch procedures, which necessarily also involve volume procedures also, is used for the first time in the present method.

Figure 4:
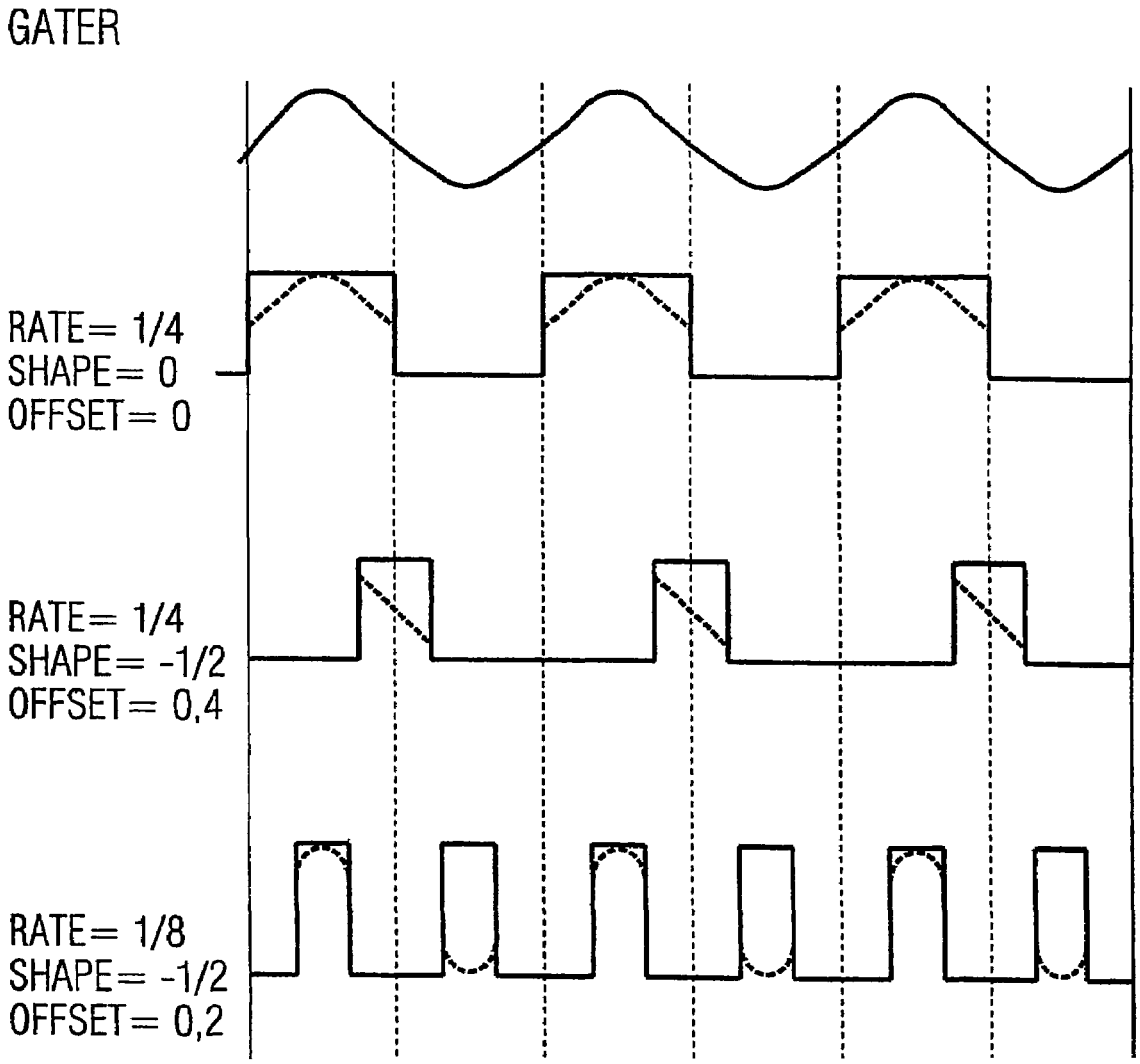
FIG. 4 shows various possible volume envelope curves for realising a Gater effect on a Back-and-For scratch effect.

FIG. 4 illustrates a simple 3-fold BACK AND FOR scratch.

This includes various volume envelope curves, which result from the adjacent gate-parameters in each case. The resulting playback curve is also illustrated, in order to demonstrate how different the final results can be by using different gate parameters. If the frequency of the BACK AND FOR scratch and the acceleration parameter 'ab' (no longer shown in the diagram) are now varied, a very large number of possible combinations can be achieved.

The first characteristic beneath the starting form (3-fold BACK AND FOR scratch) emphasises only the second half of the playback movement, eliminating the first half in each case. The Gater values for this characteristic are as follows:

RATE=¼

SHAPE=0

OFFSET=0 the characteristic of the volume envelope curve in this context is always drawn continuously, while the regions of the playback movement selected with it are shown by a broken line in each case.

In the case of the characteristic located below this, only the reverse movements of the playback movement are selected with the Gater parameters:

RATE=¼

SHAPE=−½

OFFSET=0.4

The characteristic located beneath this is another variant, in which, in each case the upper and lower turning point of the playback movement is selected by:

RATE=⅛

SHAPE=−½

OFFSET=0.2

In a further operating mode of the scratch automation, it is also possible to optimise the selection of the audio samples with which the scratch is carried out therefore making them user-independent. In this mode, pressing a key would indeed start the procedure, but this would only be completed if an appropriate beat event, which was particularly suitable for the implementation of the selected scratch, was found in the audio material "Scratch Synthesiser"

All of the features described above relate to the method with which any excerpt from the selected audio material can be reproduced in a modified manner (in the case of rhythmic material also tempo-synchronously). However, since the result (the sound) of a scratch is directly connected with the selected audio material, the resulting diversity of sound is, in principle, as great as the selected audio material itself. Since the method is parameterised, it may even be described as a novel sound-synthesis method.

In the case of "scratching" with vinyl disks, that is, playing back with a very strongly and rapidly changing speed, the shape of the sound wave changes in a characteristic manner, because of the properties of the recording method used as standard for vinyl disks. When producing the press master for the disk in the recording studio, the sound signal passes through a pre-emphasis filter according to the RIAA standard, which raises the peaks (the so-called "cutting characteristic"). All equipment used for playing back vinyl disks contains a corresponding de-emphasis filter, which reverses the effect, so that approximately the original signal is obtained.

However, if the playback rate is now no longer the same, as during the recording, which occurs, amongst other things during "scratching", then all frequency portions of the signal from the disk are correspondingly shifted and therefore attenuated differently by the de-emphasis filter. The result is a characteristic sound.

In order to achieve as authentic a reproduction as possible, similar to "scratching" with a vinyl-disk record player, when playing back with strongly and rapidly changing speeds, a further advantageous embodiment of the interactive music player according to the invention uses a scratch-audio filter for an audio signal, wherein the audio signal is subjected to pre-emphasis filtering and stored in a buffer memory, from which it can be read out at a variable tempo in dependence upon the relevant playback rates, after which it is subjected to de-emphasis filtering and played back.

Figure 6:
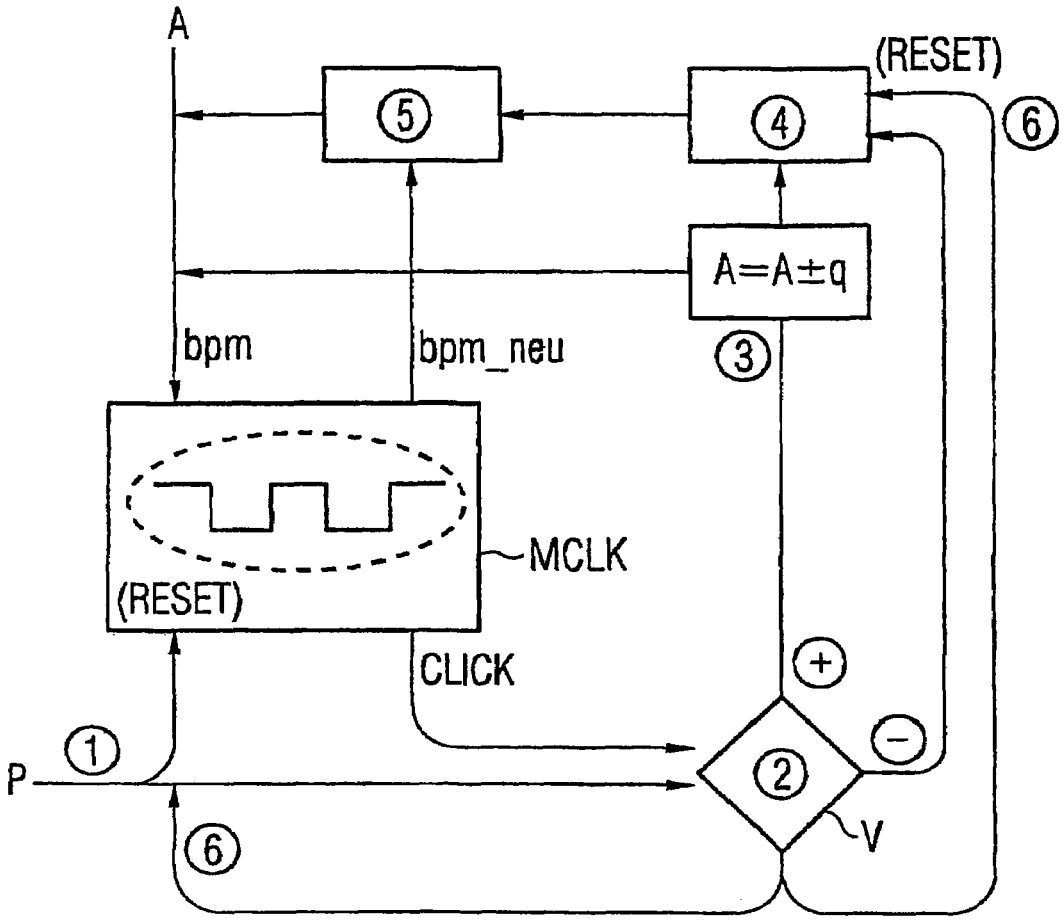
FIG. 6 shows a block circuit diagram of an additional signal processing chain for realising a scratch audio filter according to the invention.

In this advantageous embodiment of the interactive music player according to the invention with a structure corresponding to FIG. 5, a scratch-audio filter is therefore provided in order to simulate the characteristic effects described. For this purpose, especially for a digital simulation of this process, the audio signal within the playback unit PLAY from FIG. 5 is subjected to further signal processing, as shown in FIG. 6. In this context, the audio signal is subjected to a corresponding pre-emphasis filtering after the digital audio data of the piece of music to be reproduced has been read from a data medium D and/or sound medium (e.g. CD or MP3) and (above all, in the case of the MP3 format) decoded DEC. The signal pre-filtered in this manner is then stored in a buffer memory B, from which it is read out in a further processing unit R, depending on the operating mode a) or b), as described in FIG. 5, at variable rate corresponding to the output signal from the SL. The signal read out is then processed with a de-emphasis filter DEF and played back (AUDIO_OUT).

A second order digital filter IIR, that is, with two favourably selected pole positions and two favourably selected zero positions, is preferably used for the pre-emphasis and the de-emphasis filters PEF and DEF, which should have the same frequency response as in the RIAA standard. If the pole positions of one of the filters are the same as the zero positions of the other filter, the effect of both of the filters is accurately cancelled, as desired, when the audio signal is played back at the original rate. In all other cases, the named filters produce the characteristic sound effects for "scratching". Of course, the scratch-audio filter described can also be used in conjunction with any other type of music playback devices with a "scratching" function.

The tempo of the track is required from the audio material, as information for determining the magnitude of the variable "beat" and the "beating" of the gate. The tempo detection methods for audio tracks described below may, for example, be used for this purpose.

This raises the technical problem of tempo and phase matching of two pieces of music and/or audio tracks in real-time. In this context, it would be desirable if there were a possibility for automatic tempo and phase matching of two pieces of music and/or audio tracks in real-time, in order to release the DJ from this technical aspect of mixing and/or to produce a mix automatically or semi-automatically without the assistance of a specially trained DJ.

So far, this problem has only been addressed partially. For example, there are software players for the MP3 format (a standard format for compressed digital audio data), which realise pure, real-time tempo detection and matching. However, the identification of the phase still has to take place through the listening and matching carried out directly by the DJ. This requires a considerable amount of concentration from the DJ, which could otherwise be available for artistic aspects of musical compilation.

One object of the present invention is therefore to create a possibility for automatic tempo and phase matching of two pieces of music and/or audio tracks in real-time with the greatest possible accuracy.

In this context, one substantial technical hurdle which must be overcome is the accuracy of a tempo and phase measurement, which declines in direct proportion with the time available for this measurement. The problem therefore relates primarily to determining the tempo and phase in real-time, as required, for example, during live mixing.

A possible realisation for approximate tempo and phase detection and tempo and phase matching will be described below in the context of the invention.

The first step of the procedure is an initial, approximation of the tempo of the piece of music. This takes place through a statistical evaluation of the time differences between so-called beat events. One possibility for obtaining rhythm-relevant events from the audio material is provided by narrow band-pass filtering of the audio signal in various frequency ranges. In order to determine the tempo in real-time, only the beat events from the previous seconds are used for the subsequent calculations in each case. Accordingly, 8 to 16 events correspond approximately to 4 to 8 seconds.

In view of the quantised structure of music ($16^{th}$ note grid), it is possible to include not only quarter note beat intervals in the tempo calculation; other intervals ($16^{th}$, $8^{th}$, ½ and whole notes) can be transformed, by means of octaving (that is, raising their frequency by a power of two), into a pre-defined frequency octave (e.g. 90–160 bpm=beats per minute) and thereby supplying tempo-relevant information. Errors in octaving (e.g. of triplet intervals) are not relevant for the subsequent statistical evaluation because of their relative rarity.

In order to register triplets and/or shuffled rhythms (individual notes displaced slightly from the $16^{th}$ note grid), the time intervals obtained at the first point are additionally grouped into pairs and groups of three by addition of the time values before they are octaved. The rhythmic structure between beats is calculated from the time intervals using this method.

The quantity of data obtained in this manner is investigated for accumulation points. In general, depending on the octaving and grouping procedure, three accumulation maxima occur, of which the values are in a rational relationship to one another (2/3, 5/4, 4/5 or 3/2). If it is not sufficiently clear from the strength of one of the maxima that this indicates the actual tempo of the piece of music, the correct maximum can be established from the rational relationships between the maxima.

A reference oscillator is used for approximation of the phase. This oscillates at the tempo previously established. Its phase is advantageously selected to achieve the best agreement between beat-events in the audio material and zero passes of the oscillator.

Following this, a successive improvement of the approximated tempo and phase is implemented. As a result of the natural inaccuracy of the initial tempo approximation, the phase of the reference oscillator is initially shifted relative to the audio track after a few seconds. This systematic phase shift provides information about the amount by which the tempo of the reference oscillator must be changed. A correction of the tempo and phase is advantageously carried out at regular intervals, in order to remain below the threshold of audibility of the shifts and correction movements.

All of the phase corrections, implemented from the time of the approximate phase correlation, are accumulated over time so that the calculation of the tempo and the phase is based on a constantly increasing time interval. As a result, the tempo and phase values become increasingly more accurate and lose the error associated with approximate real-time measurements mentioned above. After a short time (approximately 1 minute), the error in the tempo value obtained by this method falls below 0.1%, a measure of accuracy, which is a prerequisite for calculating loop lengths.

The drawing according to FIG. 7 shows one possible technical realisation of the approximate tempo and phase detection in a music data stream in real-time on the basis of a block circuit diagram. The set-up shown can also be described as a "beat detector".

Two streams of audio events $E_i$ with a value 1 are provided as the input; these correspond to the peaks in the frequency bands F1 at 150 Hz and F2 at 4000 Hz or 9000 Hz. These two event streams are initially processed separately, being filtered through appropriate band-pass filters with threshold frequency F1 and F2 in each case.

If an event follows the preceding event within 50 ms, the second event is ignored. A time of 50 ms corresponds to the duration of a $16^{th}$ note at 300 bpm, and is therefore considerably shorter than the duration of the shortest interval in which the pieces of music are generally located.

From the stream of filtered events $E_i$, a stream consisting of the simple time intervals $T_i$ between the events is now calculated in the relevant processing units BD1 and BD2.

Two further streams of bandwidth-limited time intervals are additionally formed in identical processing units BPM_C1 and BPM_C2 in each case from the stream of simple time intervals $T_{1i}$: namely, the sums of two successive time intervals in each case with time intervals $T_{2i}$, and the sum of three successive time intervals with time intervals $T_{3i}$. The events included in this context may also overlap. Accordingly from the stream: $t_1$, $t_2$, $t_3$, $t_4$, $t_5$, $t_6$ . . . the following two streams are additionally produced:

$T_{2i}$: $(t_1+t_2)$, $(t_2+t_3)$, $(t_3+t_4)$, $(t_4+t_5)$, $(t_5+t_6)$, . . . and $T_{3i}$: $(t_1+t_2+t_3)$, $(t_2+t_3+t_4)$, $(t_3+t_4+t_5)$, $(t_4+t_5+t_6)$ . . .

The three streams . . . $T_{1i}$, $T_{2i}$, $T_{3i}$, are now time-octaved in appropriate processing units OKT. The time-octaving OKT is implemented in such a manner that the individual time intervals of each stream are doubled until they lie within a predetermined interval BPM_REF. Three data streams $T_{1io}$, $T_{2io}$, $T_{3io}$ are obtained in this manner. The upper limit of the interval is calculated from the lower bpm threshold according to the formula:

$$t_{hi}[ms]=60000/bpm_{low}.$$

The lower threshold of the interval is approximately $0.5*t_{hi}$

The consistency of each of the three streams obtained in this manner is now checked, in further processing units CHK, for the two frequency bands F1, F2. This determines whether a certain number of successive, time-octaved interval values lie within a predetermined error threshold in each case. In particular, this check may be carried out, with the following values:

For $T_{1i}$, the last 4 relevant events $t_{11o}$, $t_{12o}$, $t_{13o}$, $t_{14o}$ are checked to determine whether the following applies:

$$(t_{11o}-t_{12o})^2+(t_{11o}-t_{13o})^2+(t_{11o}-t_{14o})^2<20 \quad a)$$

If this is the case, the value $t_{110}$ will be obtained as a valid time interval.

For $T_{2i}$, the last 4 relevant events $t_{21o}$, $t_{22o}$, $t_{23o}$, $t_{24o}$ are checked to determine whether the following applies:

$$(t_{21o}-t_{22o})^2+(t_{21o}-t_{23o})^2+(t_{21o}-t_{24o})^2<20 \quad b)$$

If this is the case, the value $t_{11o}$ will be obtained as a valid time interval.

For $T_{3i}$, the last 3 relevant events $t_{31o}$, $t_{32o}$, $t_{33o}$, are checked to determine whether the following applies:

$$(t_{31o}-t_{32o})^2+(t_{31o}-t_{33o})^2<20 \quad c)$$

If this is the case, the value $t_{310}$ will be obtained as a valid time interval.

In this context, consistency test a) takes priority over b), and b) takes priority over c). Accordingly, if a value is obtained for a), then b) and c) will not be investigated. If no value is obtained for a), then b) will be investigated and so on. However, if a consistent value is not found for a), or for b) or for c), then the sum of the last 4 non-octaved individual intervals ($t_1+t_2+t_3+t_4$) will be obtained.

The stream of values for consistent time intervals obtained in this manner from the three streams is again octaved in a downstream processing unit OKT into the predetermined time interval BPM_REF. Following this, the octaved time interval is converted into a BPM value.

As a result, two streams BPM1 and BPM2 of bpm values are now available—one for each of two frequency ranges F1 and F2. In one prototype, the streams are retrieved with a fixed frequency of 5 Hz, and the last eight events from each of the two streams are used for statistical evaluation. At this point, a variable (event-controlled) sampling rate can also be used, wherein more than merely the last 8 events can be used, for example, 16 or 32 events.

These last 8, 16 or 32 events from each frequency band F1, F2 are combined and examined for accumulation maxima N in a downstream processing unit STAT. In the prototype version, an error interval of 1.5 bpm is used, that is, provided events differ from one another by at least 1.5 bpm, they are regarded as associated and are added together in the weighting. In this context, the processing unit STAT determines the BPM values at which accumulations occur and how many events are to be attributed to the relevant accumulation points. The most heavily weighted accumulation point can be regarded as the local BPM measurement and provide the desired tempo value A.

In an initial further development of this method, in addition to the local BPM measurement, a global measurement is carried out, by expanding the number of events used to 64, 128 etc. With alternating rhythm patterns, in which the tempo only comes through clearly on every fourth beat, an event number of at least 128 may frequently be necessary. A measurement of this kind is more reliable, but also requires more time.

A further decisive improvement can be achieved with the following measure:

Not only the first but also the second accumulation maximum is taken into consideration. This second maximum almost always occurs as a result of triplets and may even be stronger than the first maximum. The tempo of the triplets, however, has a clearly defined relationship to the tempo of the quarter notes, so that it can be established from the relationship between the tempi of the first two maxima, which accumulation maximum should be attributed to the quarter notes and which to the triplets.

If T2=⅔*T1, then T2 is the tempo
If T2=⅓*T1, then T2 is the tempo
If T2=⅖*T1, then T2 is the tempo
If T2=⅕*T1, then T2 is the tempo
If T2=½*T1, then T1 is the tempo
If T2=¾*T1, then T1 is the tempo
If T2=⅝*T1, then T1 is the tempo
If T2=⅘*T1, then T1 is the tempo A phase value P is approximated with reference to one of the two filtered, simple time intervals $T_i$ between the events, preferably with reference to those values which are filtered with the lower frequency F1. These are used for the rough approximation of the frequency of the reference oscillator.

The drawing according to FIG. 8 shows a possible block circuit diagram for successive correction of an established tempo A and phase P, referred to below as "CLOCK CONTROL".

Initially, the reference oscillator and/or the reference clock MCLK is started in an initial stage 1 with the rough phase values P and tempo values A derived from the beat detection, which is approximately equivalent to a reset of the control circuit shown in FIG. 2. Following this, in a further stage 2, the time intervals between beat events in the incoming audio signal and the reference clock MCLK are established. For this purpose, the approximate phase values P are compared in a comparator V with a reference signal CLICK, which provides the frequency of the reference oscillator MCLK.

If a "critical" deviation is systematically exceeded (+) in several successive events by a value, for example, of greater than 30 ms, the reference clock MCLK is (re)matched to the audio signal in a further processing stage 3 by means of a short-term tempo change $$A(i+1)=A(i)+q \text{ or}$$

$$A(i+1)=A(i)-q$$

relative to the deviation, wherein q represents a lowering or raising of the tempo. Otherwise (−), the tempo is held constant.

During the further sequence, in a subsequent stage 4, a summation is carried out of all correction events from stage 3 and of the time elapsed since the last "reset" in the internal memories (not shown). At approximately every $5^{th}$ to $10^{th}$ event of an approximately accurate synchronisation (difference between the audio data and the reference clock MCLK approximately below 5 ms), the tempo value is re-calculated in a further stage 5 on the basis of the previous tempo value, the correction events accumulated up to this time and the time elapsed since the last reset, as follows.

With q as the lowering or raising of the tempo used in stage 3 (for example, by the value 0.1), dt as the sum of the time, for which the tempo was lowered or raised as a whole (raising positive, lowering negative), T as the time interval elapsed since the last reset (stage 1), and bpm as the tempo value A used in stage 1 the new, improved tempo is calculated according to the following simple formula:

$$bpm_new=bpm*(1+(q*dt)/T).$$

Furthermore, tests are carried out to check whether the corrections in stage 3 are consistently negative or positive over a certain period of time. If this is the case, there is probably a tempo change in the audio material, which cannot be corrected by the above procedure; this status is identified and on reaching the next approximately perfect synchronisation event (stage 5), the time and the correction memory are deleted in stage 6, in order to reset the starting point in phase and tempo. After this "reset", the procedure begins again to optimise the tempo starting at stage 2.

A synchronisation of a second piece of music now takes place by matching its tempo and phase. The matching of the second piece of music takes place indirectly via the reference oscillator. After the approximation of tempo and phase in the piece of music as described above, these values are successively matched to the reference oscillator according to the above procedure, only this time the playback phase and playback rate of the track are themselves changed. The original tempo of the track can readily be calculated back from the required change in its playback rate by comparison with the original playback rate.

Moreover, the information obtained about the tempo and the phase of an audio track allows the control of so-called tempo-synchronous effects. In this context, the audio signal is manipulated to match its own rhythm, which allows rhythmically effective real-time sound changes. In particular, the tempo information can be used to cut loops of accurate beat-synchronous lengths from the audio material in real-time.

As already mentioned, when several pieces of music are mixed conventionally, the audio sources from sound media are played back on several playback devices and mixed via a mixing desk. With this procedure, an audio recording is restricted to recording the final result. It is therefore not possible to reproduce the mixing procedure or, at a later time, to start exactly at a predetermined position within a piece of music.

The present invention achieves precisely this goal by proposing a file format for digital control information, which provides the possibility of recording and accurately reproducing from audio sources the process of interactive mixing together with any processing effects. This is especially possible with a music player as described above.

The recording is subdivided into a description of the audio sources used and a time sequence of control information for the mixing procedure and additional effect processing.

Only the information about the actual mixing procedure and the original audio sources is required in order to reproduce the results of the mixing procedure. The actual digital audio data are provided externally. This avoids procedures involving the copying of protected pieces of music which can be problematic under copyright law. Accordingly, by storing digital control data, which relate to playback position, synchronisation information, real-time interventions using audio-signal-processing etc., mixing procedures for several audio pieces representing a mix of audio sources together with any effect processing used, can be realised as a new complete work with a comparatively long playback duration.

This provides the advantage, that a description of the processing of the audio sources is relatively short by comparison with the audio data from the mixing procedure, and the mixing procedure can be edited and re-started at any desired position. Moreover, existing audio pieces can be played back in various compilations or as longer, interconnected interpretations.

With existing sound media and music players, it has not so far been possible to record and reproduce the interaction with the user, because the known playback equipment does not provide the technical conditions required to control this accurately enough. This has only become possible as a result of the present invention, wherein several digital audio sources can be reproduced and their playback positions established and controlled. As a result, the entire procedure can be processed digitally, and the corresponding control data can be stored in a file. These digital control data are preferably stored with a resolution which corresponds to the sampling rate of the processed digital audio data.

The recording is essentially subdivided into two parts:

a list of audio sources use, e.g. digitally recorded audio data in compressed and uncompressed form such as WAV, MPEG, AIFF and digital sound media such as a compact disk and the time sequence of the control information.

The list of audio sources used contains, for example:

information for identification of the audio source additionally calculated information, describing the characteristics of the audio source (e.g. playback length and tempo information)

descriptive information on the origin and copyright information for the audio source (e.g. artist, album, publisher etc.)

meta information, e.g. additional information about the background of the audio source (e.g. musical genre, information about the artist and publisher).

Amongst other data, the control information stores the following:

the time sequence of control data the time sequence of exact playback positions in the audio source intervals with complete status information for all control elements acting as re-starting points for playback.

The following section describes one possible example for administering the list of audio pieces in an instance in the XML format. In this context, XML is an abbreviation for Extensible Markup Language. This is a name for a meta language for describing pages in the World Wide Web. By contrast with HTML (Hypertext Markup Language), it is possible for the author of an XML document to define within the document itself certain extensions of XML in the document-type-definition-part of the document and also to use these within the same document.

```
<?xml version="1.0" encoding="ISO-8859-1"?>
<MJL VERSION="version description">
<HEAD PROGRAM="program name" COMPANY="company name"/>
<MIX TITLE="title of the mix">
<LOCATION FILE="marking of the control information file" PATH="storage location for control information file"/>
```

<COMMENT>comments and remarks on the mix </COMMENT>
<MIX>
<PLAYLIST>
<ENTRY TITLE="title entry 1" ARTIST="name of author" ID="identification of title">
<LOCATION FILE="identification of audio source" PATH="memory location of audio source" VOLUME="storage medium of the file"/>
<ALBUM TITLE="name of the associated album" TRACK="identification of the track on the album"/>
<INFOPLAYTIME="playback time in seconds" GENRE_ID="code for musical genre"/>
<TEMPO BPM="playback time in BPM" BPM_QUALITY="quality of tempo value from the analysis"/>
<CUE POINT 1="position of the first cue point" . . . POINTn="position of the $n^{th}$ cue point"/>
<FADE TIME="fade time" MODE="fade mode">
<COMMENT>comments and remarks on the audio piece>
<IMAGE FILE="code for an image file as additional commentary option"/>
<REFERENCE URL="code for further information on the audio source"/>
</COMMENT.
</ENTRY>
</ENTRY . . . >
</ENTRY>
</PLAYLIST>
</MJL>

The following section describes possible preliminary settings and/or control data for the automatic production of scratch effects as described above.

This involves a series of operating elements, with which all of the parameters for the scratch can be brought forward. These include:

- Scratch type (Full-Stop, Back & For, Back-Spin and many more)
- Scratch duration (1, 2, . . . beats—also pressure-duration-dependent, see below)
- Scratch rate (rate of peaks)
- Duration of acceleration a (duration of a change in rate from +/−1)
- Scratch frequency (repetitions per beat in the case of rhythmic scratches)
- Gate frequency (repetitions per beat)
- Gate shape (relationship of "on" to "off" phase)
- Gate offset (offset of the gate relative to the beat)
- Gate routing (allocation of the gate to other effect parameters).

These are only some of the many conceivable parameters, which arise depending on the type of scratch effect realised.

The actual scratch is triggered after the completion of the preliminary adjustments via a central button/control elements and develops automatically from this point onward. The user only needs to influence the scratch via the moment at which he/she presses the key (selection of the scratch audio example) and via the duration of pressure on the key (selection of scratch length).

The control information, referenced through the list of audio pieces, is preferably stored in binary format. The essential structure of the stored control information in a file can be described, by way of example, as follows:

```
[Number of control blocks N]
For [number of control blocks N] is repeated {
[time difference since the last control block in
milliseconds]
[number of control points M]
For [number of control points M] is repeated {
[identification of controller]
[Controller channel]
[New value of the controller]
}
}
```

[identification of controller] defines a value which identifies a control element (e.g. volume, rate, position) of the interactive music player. Several sub-channels [controller channel], e.g. number of playback module, may be allocated to control elements of this kind. An unambiguous control point M is addressed with [identification of controller], [controller channel].

As a result, a digital record of the mixing procedure is produced, which can be stored, reproduced non-destructively with reference to the audio material, duplicated and transmitted, e.g. over the Internet.

Figure 9:
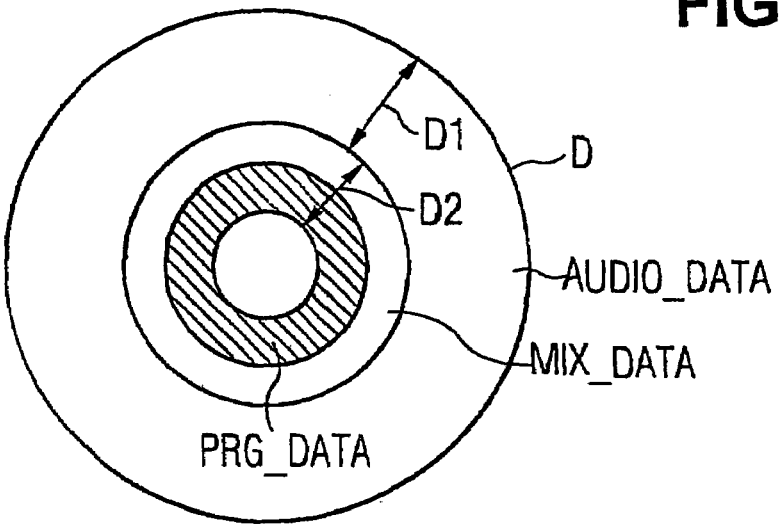
FIG. 9 shows a data medium, which combines audio data and control files for the reproduction of scratch effects or complete works produced from the audio data in accordance with the invention.

One advantageous embodiment with reference to such control files is a data medium D, as shown in FIG. 9. This provides a combination of a normal audio CD with digital audio data AUDIO_DATA in a first data region D1 with a program PRG_DATA disposed in a further data region D2 of the CD for playing back any mixing files MIX_DATA which may also be present, and which draw directly on the audio data AUDIO_DATA stored on the CD. In this context, the playback and/or mixing application PRG_DATA need not necessarily be a component of a data medium of this kind. The combination of a first data region D1 with digital audio information AUDIO_DATA and a second data region with one or more files containing the named digital control data MIX_DATA is advantageous, because, in combination with a music player according to the invention, a data medium of this kind contains all the necessary information for the reproduction of a new complete work created at an earlier time from the available digital audio sources.

However, the invention can be realised in a particularly advantageous manner on an appropriately programmed digital computer with appropriate audio interfaces, in that a software program executes the procedural stages of the computer system (e.g. the playback and/or mix application PRG_DATA) presented above.

Provided the known prior art permits, all of the features mentioned in the above description and shown in the diagrams should be regarded as components of the invention either in their own right or in combination.

Further information, further developments and details are provided in combination with the disclosure of the German patent application by the present applicant, reference number 101 01 473.2–51, the content of which is hereby included by reference.

The above description of preferred embodiments according to the invention is provided for the purpose of illustration. These exemplary embodiments are not exhaustive. Moreover, the invention is not restricted to the form exactly as indicated, indeed, numerous modifications and changes are possible within the technical doctrine indicated above. One preferred embodiment has been selected, and described in order to illustrate the basic details and practical applications of the invention, thereby allowing a person skilled in the art to realise the invention. A number of preferred embodiments and further modifications may be considered in specialist areas of application.

| List of reference symbols | |
|---|---|
| beat | duration of a quarter note of a present track |
| ab | duration of the slowing and acceleration procedure |
| c | standstill phase |
| SAMPLE | playback position of the audio signal |
| t | time |
| v | velocity |
| x | distance |
| T | total duration of a scratch |
| rü | reverse phase |
| vo | forward phase |
| RATE | frequency of a gate procedure |
| SHAPE | relationship of "on" to "off" phase |
| OFFSET | phase displacement, relative to the reference beat |
| Ei | event in an audio stream |
| Ti | time interval |
| F1, F2 | frequency bands |
| BD1, BD2 | detectors for rhythm-relevant information |
| BPM_REF | reference time interval |
| BPM_C1, BPM_C2 | processing units for tempo detection |
| T1i | un-grouped time intervals |
| T2i | pairs of time intervals |
| T3i | groups of three time intervals |
| OKT | time-octaving units |
| T1io . . . T3io | time-octaved time intervals |
| CHK | consistency testing |
| BPM1, BPM2 | independent streams of tempo values bpm |
| STAT | statistical evaluation of tempo values |
| N | accumulation points |
| A, bpm | approximate tempo of a piece of music |
| P | approximate phase of a piece of music |
| 1 . . . 6 | procedural stages |
| MCLK | reference oscillator/master clock |
| V | comparator |
| + | phase agreement |
| − | phase shift |
| q | correction value |
| bpm_new | resulting new tempo value A |
| RESET | new start in case of change of tempo |
| CD-ROM | audio data source/CD-ROM drive |
| S | central instance/scheduler |
| TR1 . . . TRn | audio data tracks |
| P1 . . . Pn | buffer memory |
| A1 . . . An | current playback positions |
| S1 . . . Sn | data starting points |
| R1, R2 | controller/control elements |
| LP | low-pass filter |
| DIFF | differentiator |
| SW1 | switch |
| IN1, IN2 | first and second input |
| a | first operating mode |
| b | second operating mode |
| SL | means for ramp smoothing |
| PLAY | player unit |
| DEC | decoder |
| B | buffer memory |
| R | reader unit with variable tempo |
| PEF | pre-emphasis-filter/pre-distortion filter |
| DEF | de-emphasis filter/reverse-distortion filter |
| AUDIO_OUT | audio output |
| D | sound carrier/data source |
| D1, D2 | data regions |
| AUDIO_DATA | digital audio data |
| MIX_DATA | digital control data |
| PRG_DATA | computer program data |

The invention claimed is:

1. A Method for electrical sound production, wherein digitally stored control information comprising, playback direction information, playback rate information is used with an audio signal (sample) provided in digital format and with musical tempo information automatically retrieved from the sample or from an external source to modulate playback of the sample comprising the following steps:

a) determining a playback position within the sample using the automatically retrieved musical tempo information;

b) playing back the sample by applying the digitally stored control information to the sample relatively to the playback position determined in step a).

2. The method for electrical sound production according to claim 1, wherein the digitally stored control information is repeatedly applied at a rate to the sample and for a duration, controlled by the automatically retrieved tempo information.

3. The method for electrical sound production according to claim 1, wherein the digitally stored control information is repeatedly applied at a rate and for a duration, controlled by an external reference tempo.

4. The method for electrical sound production according to claim 1, wherein the digitally stored control information simulates physical movement procedures of a vinyl disk on a turntable of a record player, and the automatic modulation of the audio signal is implemented in such a manner that a so-called musical scratch effect results.

5. The method for electrical sound production according to claim 1, wherein, in order to generate the digital control information, physical movement procedures of a vinyl disk and a volume fader during a manual scratch are recorded as sequence of time-discrete values.

6. The method for electrical sound production according to claim 1, wherein, in order to generate control information, sequences of time-discrete values are numerically constructed, in particular, by means of graphic editing.

7. The method for electrical sound production according to claim 6, wherein, the process of numerically generating control information, by means of graphic editing, for simulating physical movement procedures of a vinyl disk and a volume during a manual scratch, is controlled by the automatically retrieved tempo information.

8. The method for electrical sound production according to claim 1, wherein in order to determine musical tempo information, a detection of tempo and phase of music information provided in a digital format takes place, with reference to the audio signal (sample), according to the following procedural steps:

a. approximation of the tempo (A) of the music information through a statistical evaluation (STAT) of the time differences (Ti) of rhythm-relevant beat information in the digital audio data (Ei), b. approximation of the phase (P) of the piece of music by the position of the beats in the digital audio data in the time frame of a reference oscillator (MCLK) oscillating with a frequency proportional to the tempo determined, c. successive correction of the detected tempo (A) and phase (P) of the music information by a possible phase displacement of the reference oscillator (MCLK) relative to the digital audio information through evaluation of the resulting systematic phase displacement and regulation of the frequency of the reference oscillator proportional to the detected phase displacement.

9. The method for electrical sound production according to claim 1, wherein rhythm-relevant beat information (Ti) is obtained through band-pass filtering (F1, F2) of the basic digital audio data within frequency ranges.

10. The method for electrical sound production according to claim 1, wherein, if necessary, rhythm intervals in the audio data are transformed (OKT) by multiplication of the frequency by powers of two into a pre-defined frequency octave, wherein they provide time intervals (T1io . . . T3io) for determining the tempo.

11. The method for electrical sound production according to claim 10, wherein the frequency transformation (OKT) is preceded by a grouping of rhythmic intervals (Ti), by addition of the time values.

12. The method for electrical sound production according to claim 9, wherein the quantity of data obtained for time intervals (BPM1, BPM2) in the rhythm-relevant beat information is investigated for accumulation points (N) and the approximate tempo determination takes place by the information with an accumulation maximum.

13. The method for electrical sound production according to claim 8, wherein, for the approximation of the phase (P) of the piece of music, the phase of the reference oscillator (MCLK) is selected in such a manner that the greatest possible agreement is adjusted between the rhythm-relevant beat information in the digital audio data and the zero-passes of the reference oscillator (MCLK).

14. The method for electrical sound production according to claims 1, wherein a successive correction (2,3,4,5) of the detected tempo and phase of the piece of music is carried out at regular intervals in such short time intervals that resulting correction movements or correction shifts remain below the threshold of audibility.

15. The method for electrical sound production according to claim 14, wherein, in the event that the corrections are always either negative or positive (6) over a predeterminable period, a new (RESET) approximate detection of tempo (A) and phase (P) takes place with subsequent successive correction (2,3,4,5).

16. A interactive music player, comprising:

a. a means for graphic representation of beat limits determined with a tempo and phase detection function, in a piece of music in real-time during playback, b. a first control element (R1) for switching between a first operating mode (a) in which the piece of music is played back at a constant tempo, and a second operating mode (b), in which the following parameters are influenced: playback position, playback direction, playback rate, playback volume, c. a second control element for specifying control information, control information determined for manipulating the playback position, playback direction, playback rate and playback volume, and d. a third control element for triggering the automatic manipulation of the piece of music using the tempo of the tempo detection, the playback position, playback direction, playback rate and volume specified with the second control element,wherein the tempo information is used to manipulate at least one of the following information: playback direction, playback rate, volume.

17. The interactive music player according to claim 16, wherein, in order to smooth a stepped characteristic of time-limited playback position data, a means for ramp smoothing (SL) is provided, through which a ramp of constant gradient can be triggered for each predetermined playback-position message, over which the smoothed signal travels in a predeterminable time interval from its previous value to the value of the playback-position message.

18. The interactive music player according to claim 16, wherein a linear digital low-pass filter (LP), or a second-order resonance filter, is used for smoothing a stepped characteristic of time-limited predetermined playback-position data.

19. The interactive music player according to claim 16, wherein, in the event of a change between the operating modes (a,b), the position reached in the preceding mode is used as the starting position in the new mode.

20. The interactive music player according to claim 16, wherein, in the event of a change between the operating modes (a,b), the current playback rate (DIFF) reached in the preceding mode can be guided to the playback rate corresponding to the new operating mode, by a smoothing function, or a ramp smoothing function (SL) or a linear digital low-pass filter (LP).

21. The interactive music player according to claim 16, wherein each audio data stream played back is manipulated in real-time by signal-processing means.

22. The interactive music player according to claim 16, wherein real-time interventions are stored over the time course as digital control information (MIX_DATA), those for a manual scratch intervention with a separate control element (R2) or additional signal processing.

23. The interactive music player according to claim 22, wherein stored digital control information provides a format, which comprises information for the identification of the processed piece of music and a relevant time sequence allocated to the piece of music for playback positions and status information relating to the control elements of the music player.

24. The interactive music player according to claim 22, which is realized through an appropriately programmed computer system provided with audio interfaces.

25. A computer-readable medium (D) having instructions stored thereon to cause a computer to execute a method, the medium comprising:

a. a first data region (D1) with digital audio data (AUDIO_DATA) for one or more pieces of music (TR1 . . . TRn) and b. a second data region (D2) with a control file (MIX DATA) with digital controlled information for controlling the functions of a music player, wherein the control data (MIX_DATA) of the second data region (D2) refer to audio data (AUDIO_DATA) in the first data region (D1) which are combined by the functions of the music player being controlled by the control data (MIX-Data).

26. The data medium (D) according to claim 25, wherein the digital control information (MIX_DATA) in the second data region (D2) provides interactive records of manual scratch interventions or the starting points and type of automatic scratch interventions into pieces of music representing a new complete work of the digital audio information (AUDIO_DATA) for pieces of music in the first data region (D1).

27. The data medium (D) according to claim 25, wherein stored digital control information (MIX_DATA) in the second data region (D2) provides a format, which comprises information for the identification of the processed piece of music (TR1 . . . TRn) in the first data region (D1) and a relevant time sequence of playback positions allocated to the latter as well as status information for the control elements of music player.

28. The data medium (D) according to claim 25, with a computer loadable data structure (PRG_DATA), which is arranged on the data medium (D) according to and can be loaded directly into the internal memory of a digital com puter and comprises software segment, with which the computer adopts the function of a music player, with which, a complete work represented by the control data (MIX-_DATA) is played back according to the control data (MIX-_DATA) in the second data region (D2) of the data medium (D), which refer to audio data (AUDIO_DATA) in the first data region (D1) of the data medium (D), whenever the software product (PRG_DATA) is run on a computer.

29. The data medium (D) according to claim 25, being a compact disc.

* * * * *

UNITED STATES PATENT AND TRADEMARK OFFICE

CERTIFICATE OF CORRECTION

PATENT NO. : 7,041,892 B2
APPLICATION NO. : 10/481391
DATED : May 9, 2006
INVENTOR(S) : Friedemann Becker It is certified that error appears in the above-identified patent and that said Letters Patent is hereby corrected as shown below:

Column 20
Line 47, change "The data medium (D) according to claim 25, wherein" to --The medium (D) according to claim 25, wherein--.
Line 55, change "The data medium (D) according to claim 25, wherein" to --The medium (D) according to claim 25, wherein--.
Line 63, change "The data medium (D) according to claim 25, with a" to --The medium (D) according to claim 25, with a--.

Column 22
Line 3, change "The data medium (D) according to claim 25, being a" to --The medium (D) according to claim 25, being a--.

Signed and Sealed this

Fifth Day of September, 2006

JON W. DUDAS
*Director of the United States Patent and Trademark Office*